US005895597A

United States Patent [19]

Sherrill

[11] Patent Number: 5,895,597

[45] Date of Patent: Apr. 20, 1999

[54] ELECTRIC HEATER SUPPORT AND MOUNTING ASSEMBLY

[75] Inventor: Jimmy L. Sherrill, Cookeville, Tenn.

[73] Assignee: Tutco, Inc., Wayne, Pa.

[21] Appl. No.: 08/713,540

[22] Filed: Sep. 13, 1996

[51] Int. Cl.[6] ..... H05B 3/06; F24H 3/04

[52] U.S. Cl. ..... 219/536; 219/532; 392/347; 392/379

[58] Field of Search ..... 219/532, 536, 219/537, 548, 542; 338/315, 316, 317, 318, 319, 320; 165/81, 82; 248/901; 403/52, 53

*Primary Examiner*—Teresa Walberg
*Assistant Examiner*—Thor S. Campbell
*Attorney, Agent, or Firm*—Patton Boggs LLP

[57] ABSTRACT

An electric heater support and mounting assembly is described for reducing or substantially eliminating noise resulting from the vibration in the heating element. The support and mounting assembly comprises a housing having a plurality of unique openings for receiving a plurality of arms extending from a support plate. The openings firmly engage the arms so as to prevent rattling while enabling the arms to move within the opening to accommodate thermal expansion of the support plate.

21 Claims, 2 Drawing Sheets

ELECTRIC HEATER SUPPORT AND MOUNTING ASSEMBLY

FIELD OF THE INVENTION

The invention relates to the art of electric heaters. In particular, the invention relates to an improved support and mounting assembly for an electric heater.

BACKGROUND OF THE INVENTION

Electric heaters wherein a support and mounting assembly supports a plurality of insulators for a helical heating element are shown in U.S. Pat. Nos. 5,329,098 (Howard et al.), 5,324,919 (Howard et al.) and 4,617,547 (Howard et al.). In these patents, there are several types of heater support and mounting assemblies shown. Generally, these assemblies comprise a support element, for holding and supporting the insulators, mounted within a housing. The housing is generally a continuous U-shaped sheet of material designed to serve as a portion of the air duct in which the heater is to be inserted.

These patents depict and describe a variety of ways known in the art for attaching the support element to the housing. The heater support and mounting assembly in U.S. Pat. Nos. 5,329,098 and 5,324,919 show the support element having projections which are inserted and extend through slots in the sidewalls of the housing. U.S. Pat. No. 4,617,547 shows an assembly where the support element has protruding down-turned rods which are received by projections along the outside edge of the housing. Some other ways of attaching the support element to the housing discussed in these patents include welding or riveting.

The problem with the support and mounting assemblies heretofore is that the support element was either rigidly affixed to the housing or loosely inserted into a portion of the housing. The support element provides support for the insulators which, in turn, support the electric heating element. The current running through the electric heating element induces a vibration in the support and mounting assembly that results in a noise, for instance a rattle or chatter, at any loose fitting connection. This noise has been a persistent problem for electric heaters wherein the support element is loosely inserted in a slot within the housing. This problem can be overcome by welding or riveting the support element to the housing. However, when the support element is rigidly affixed to the housing this reduces the assembly's ability to accommodate thermal expansion, particularly, in the support element which results in stresses in the support element and/or housing.

Therefore, there is a need for an electric heater support and mounting assembly that holds the support element in a manner that minimizes noise associated with vibration of the heating element while allowing the support element to move within the housing to relieve stresses resulting from thermal expansion.

Another concern in the design and manufacture of an electric heater support and mounting assembly is the number of parts and the expediency of the overall assembly process. Assemblies that require numerous parts generally require additional assembly steps and cost more than those utilizing fewer parts. Therefore, there is a need to provide an electric heater support and mounting assembly that can readily be assembled and has a minimum number of components.

Accordingly, it is an object of the present invention to provide an electric heater support and mounting assembly having a plurality of joints each comprising an opening in a mounting element for receiving and firmly holding a portion of a support element in a manner that reduces or prevents the support element from rattling or chattering within the opening while allowing the inserted portion of the support element to move within the opening to accommodate thermal expansion of the support element.

It is another object of the present invention to provide an electric heater support and mounting assembly having a plurality of joints each comprising an opening having a tension member which forces an arm of a support element extended through the opening against a side of the opening and thereby substantially reducing or preventing the arm from rattling or chattering within the opening.

It is still a further object of the present invention to provide an electric heater support and mounting assembly having a joint consisting essentially of an opening within a housing formed by removing material from the housing and a protruding member of a support element extending through the opening whereby the protruding member is able to move within the opening but is prevented from vibrating against the side of the opening.

SUMMARY OF THE INVENTION

The heater support and mounting assembly of the invention provides a joint that enables a support element to readily be coupled with a mounting element. The joint of the invention holds the support element firmly within the mounting element while enabling the support element to move with respect to the mounting element to accommodate thermal expansion of the support element.

The mounting element affixes the support element to a structural member which may be, for instance, a part of a device. The support element is designed to support the heating element in a spaced apart arrangement from the mounting element and structural member.

DETAILED DESCRIPTION OF THE INVENTION

Figure 1:
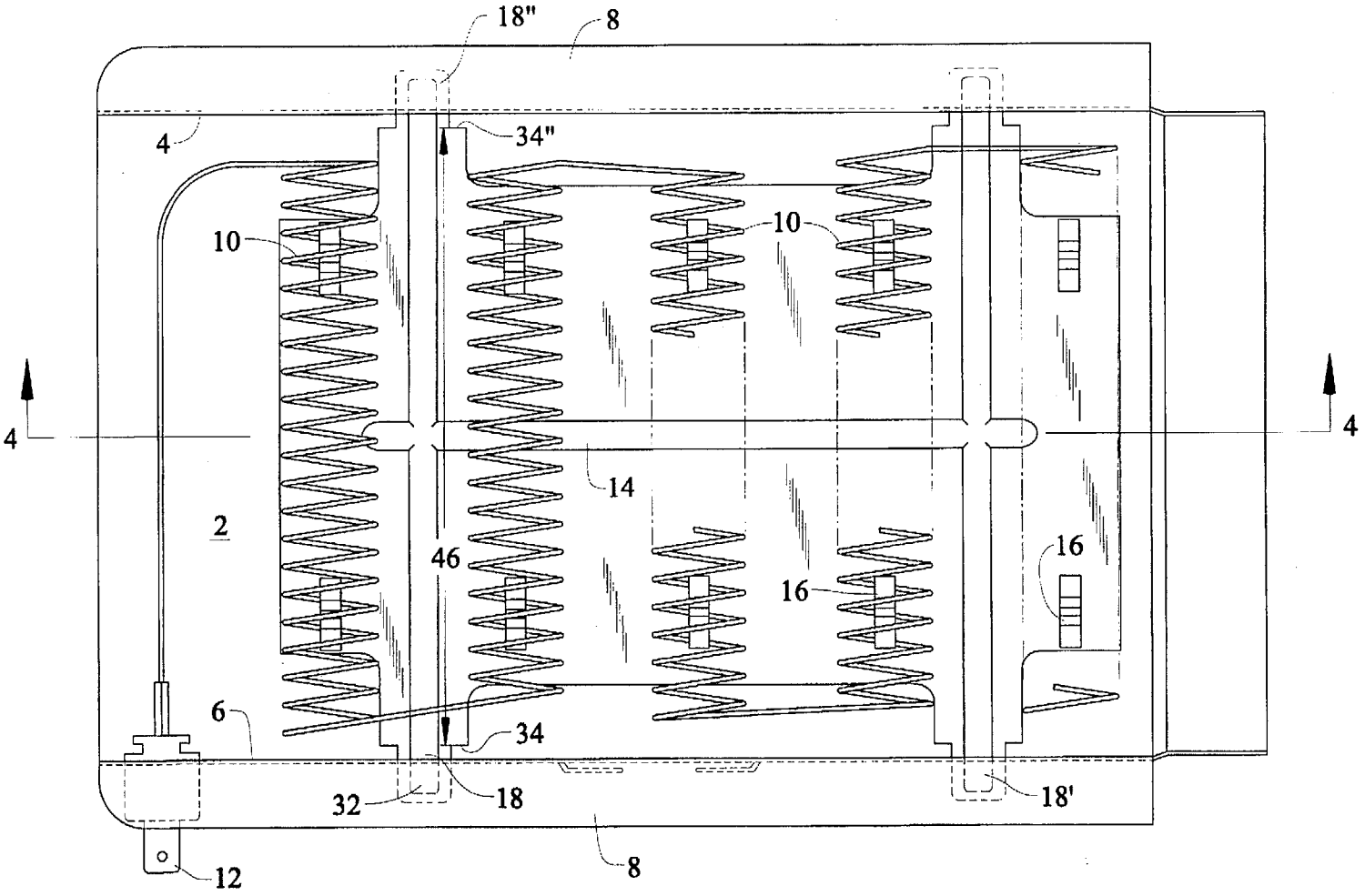
FIG. 1 is a plan view of an electric heater in accordance with a preferred embodiment of the invention.

Before the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

In the Figures, the prime and double prime numeric designation identifies a second or third item of similar type (e.g., the projection arms 18, 18' and 18"). The plural of the base number collectively includes all the prime and double prime numbers, unless noted otherwise.

Figure 3:
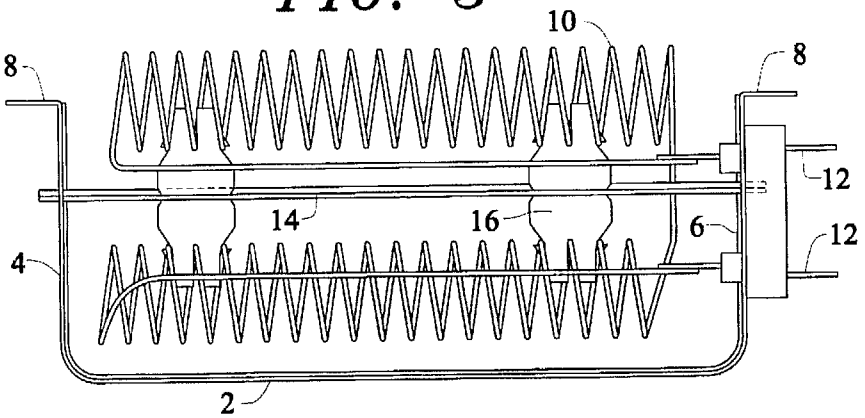
FIG. 3 is an end view of the heater shown in FIG. 1.

FIGS. 1 & 3 show an electric heater in accordance with a preferred embodiment of the invention designed to be attached to a clothes dryer (not shown). The heater in accordance with the invention may, of course, be designed for use with other equipment. The heater includes a housing formed by a bottom wall 2 and opposed sidewalls 4 and 6. Each of the sidewalls includes a tab 8 at its upper edge for facilitating attachment of the housing to the frame of the clothes dryer. The tab is shown as extending outward, but may be of various shapes, depending on the particulars of the intended application of the heater.

The heater shown in the Figures uses an electric heating coil 10 for heating air flowing past the heater through the housing, for instance, in a clothes dryer. The coil is supplied with electricity through terminals 12 as is known in the art. Although, many orientations are possible, the coil is, preferably, arranged on the support element within the housing so that it is oriented either parallel or perpendicular to the direction of air flow.

Figure 2:
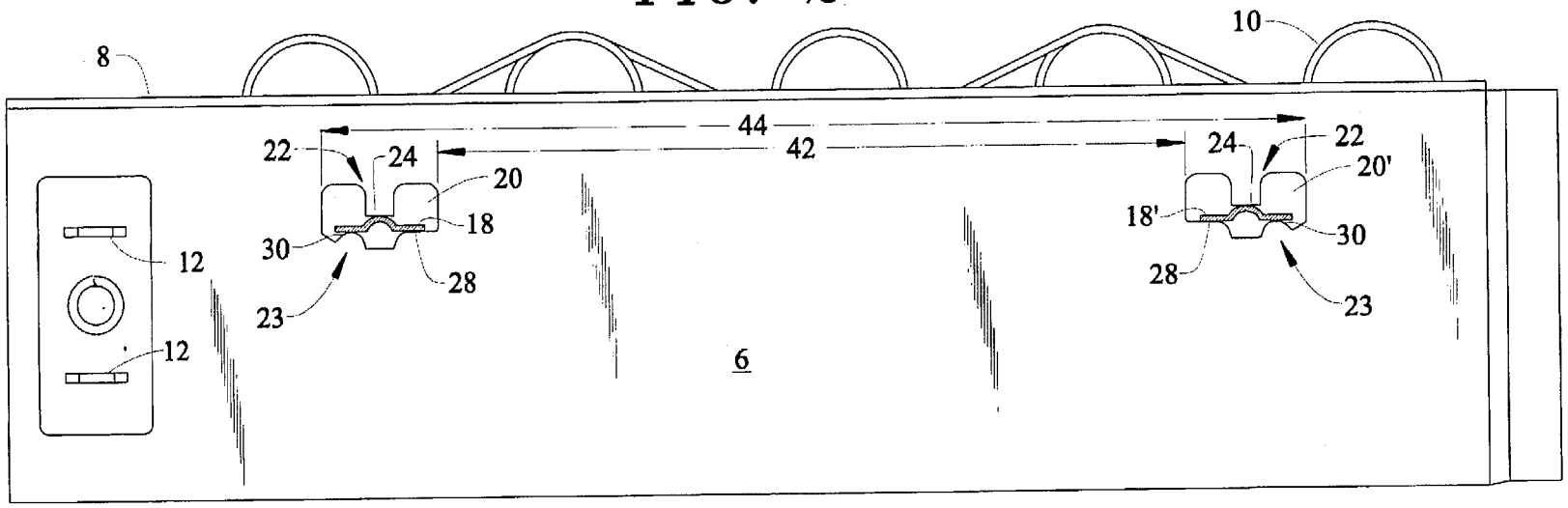
FIG. 2 is a side view of the heater shown in FIG. 1.

The coil is supported within the housing by a metal plate 14, which in turn supports a number of ceramic insulators 16, which are known in the art. The plate 14 has projection arms 18 that extend through openings 20, as shown in FIG. 2, in the sidewalls 4 and 6 to support the plate. The support element can be supported within the housing by three or more projection arms. Preferably, the plate will be supported within the housing by four projection arms, two held by the first sidewall 4 and two held by the second sidewall 6. The sidewalls 4 and 6 are preferably capable of being separated slightly during assembly to enable the ends of the projection arms to be readily fitted into the openings and then returning back to their original position.

The openings 20 are formed to receive and hold the projection arms 18. More particularly, the openings are designed in a manner that accommodates thermal expansion of the plate in all directions while at all times firmly holding the projection arms to reduce noise resulting from the arms vibrating within the openings in the housing. The openings comprise an upper side 22 and a lower side 23, which opposes the upper side. For discussion purposes, the inner portion and the outer portion of the openings 20 refers to the portion along the length of the opening closest to the center and the outside edges of the housing, respectively. The upper side 22 preferably comprises a finger 24 extending inwardly toward the lower side. More preferably, the finger 24 is positioned offset from the center of the opening 20.

The lower side 23 is preferably designed to contact the arm 18 in at least two places. More preferably, the lower side will be shaped so as to define two contact portions 28 and 30. The first contact portion 28 which is substantially flat is located toward the inner portion of the opening 20. The second contact portion 30, which is located toward the outer portion of the opening, is rounded so that it tangentially contacts the surface of the projection arm 18. On the opposite side of the projection arm, the finger 24 contacts the projection arm 18 urging it against the first and second contact portions 28 and 30 of the lower side 23.

Figure 5:
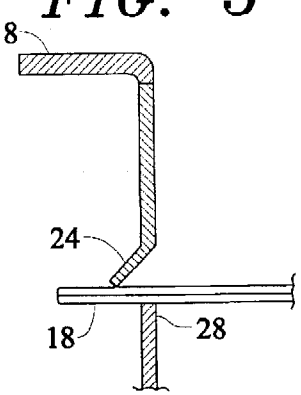
FIG. 5 is a cross-sectional view taken along line 5—5 of FIG. 4.
Figure 4:
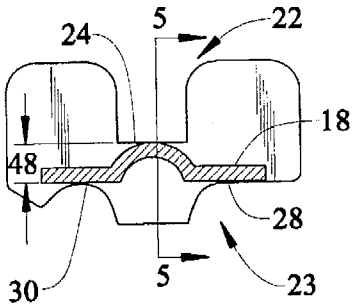
FIG. 4 is an enlarged view of the opening in the mounting element of the preferred embodiment of the invention.

The finger 24 is angled outwardly from the side wall, as depicted in FIG. 5. The flexing of the finger outwardly enables the finger to readily receive the projection arm 18. As shown in FIG. 4, the preferred distance between the end of the outwardly angled finger 24 and the contact portions 28 and 30, prior to insertion of the projection arm, should be slightly smaller than the overall thickness 48 of the projection arm. It is intended that the projection arm 18 be inserted with a force that causes the finger to outwardly flex so that the finger provides a continuous force on the projection arm urging it against the contact portions 28 and 30. This force is designed to hold the projection arm 18 firmly so as to prevent the arm from chattering and/or vibrating within the opening. At the same time, the force is intended to allow the arm to move within the opening during thermal expansion of the plate.

The projection arm 18 has an insertion tab 32 that extends beyond a shoulder stop 34. The insertion tab 32 is a narrow portion of the projection arm 18 that is sized to fit within the opening 20. The shoulder stop 34 is a portion of the arm that prevents the projection arm from extending too far through the opening 20. Preferably, the shoulder stop 34 is a portion of the arm that is wider than the tab 32 and unable to fit through the opening 20. Alternatively, the tab portion can extend directly from the main body of the plate and the side of the plate can act as the shoulder stop.

The two projection arms 18 and 18' extending outwardly from the same side of the plate are spaced apart to provide adequate support for the plate. The openings in the sidewall 4 and 6 of the housing are spaced apart to align with the projection arms. As shown in FIG. 2, the distance 42 between the inside edges of the openings 20 and 20' in the sidewall are designed to accommodate the minimum distance (i.e. at minimum temperature) between the projection arms. The length of the openings 20 and 20', which define the distance 44 between the outside edges of the openings, are sized to account for the maximum distance between the projection arms at full expansion (i.e. at maximum temperature).

Typically, the minimum distances are measured when the plate is at about room temperature and the maximum distances are determined by measuring or calculating the expansion of the plate at its maximum anticipated temperature, for instance between 1200° F. and 1500° F. Therefore, when viewing an assembled unit at room temperature, the projection arms will be positioned toward the inner portion of the openings.

As shown in FIG. 1, the distance 46 from the edge of one shoulder stop 34 to the edge of the shoulder stop 34" on the opposite side of the plate is similarly sized based on the maximum is distance between the edges at the plate's maximum temperature. Preferably, the distance between the edges of these shoulder stops 34 and 34" is sized so that at the plate's maximum expansion, i.e. at the maximum anticipated temperature, both shoulder stops are not able to contact both sidewalls 4 and 6 at the same time. When the plate is at a minimum temperature, the tab portion 32 must be sufficiently long enough to remain within the opening 20 in the side wall 4 while the shoulder stop 34" for the arm on the opposite side is in contact with the opposing sidewall 6. These criteria determine the relative dimensions of the tab portions 32 of the projection arms 18 and the shoulder stops 34 for the plate.

The projection arms 18 may be of any suitable shape including flat or round. The projection arms 18 are preferably formed as a part of the support plate 14. More preferably, the projection arms are substantially flat with a rounded portion 36 extending lengthwise along the tab portion 32 for providing tangential contact with the finger 24. This round portion 36 is typically formed by embossing the projection arm to form a rib on one side of the substantially flat arm. This round portion provides point contact with the finger as the projection arm moves within the opening.

In operation, the heater is cycled through a broad range of temperatures. As a direct result of these temperature changes, the plate encounters forces in many directions due to thermal expansion. Thermal expansion of the plate is most pronounced in the two directions within the plane of the plate. Expansion in these directions will result in the projection arms: i) moving from the inner portion of the opening along the length of the opening toward the outer portion and ii) extending further through the opening along the length of the projection arm.

Any movement due to expansion that is outside the plane of the plate can be accommodated by the further flexing of the finger. At all times during the operation of the heater, the projection arms are held under tension against the contact portions of the lower side of the opening. This helps to reduce or substantially prevent any noise resulting from the projection arms rattling (or chattering) within the openings.

What is claimed is:

1. An electric heater support and mounting assembly comprising:

a support means for supporting an electric heating element, wherein said support means has at least one arm;

a mounting means for affixing the support means to a support structure, wherein said mounting means has at least one opening having a first edge and an opposing second edge; and at least one joint consisting essentially of said opening and said arm;

wherein a segment of said arm extends through said opening, said first edge contacts a first portion of said arm segment and urges an opposing second portion of said arm segment against said second edge, and said joint enables said arm to move within said opening to accommodate thermal expansion of said support means.

2. The assembly of claim 1 wherein said first edge has a protruding member that imposes a force, directed toward said second edge, on said first portion of said arm segment.

3. The assembly of claim 2 wherein said first portion of said arm is rounded for tangentially contacting said protruding member.

4. The assembly of claim 3 wherein said rounded portion of said first portion extends along the length of said arm.

5. The assembly of claim 1 wherein said second edge has at least one rounded portion that tangentially contacts said arm segment.

6. The assembly of claim 1 wherein said support element has at least two arms extending in the same direction in a spaced apart arrangement and said mounting means has at least two openings for simultaneously engaging said arms.

7. The assembly of claim 6 wherein said openings are substantially the same shape.

8. The assembly of claim 6 wherein said at least two openings are sufficiently wide to accommodate the change in distance between said at least two arms caused by thermal expansion of said support element.

9. The assembly of claim 8 wherein said openings are substantially the same shape.

10. The assembly of claim 6 wherein said support element has a third arm extending in a direction opposite said at least two arms and said mounting means has a third opening for engaging said third arm while said at least two arms are engaged in said at least two openings.

11. The assembly of claim 1 wherein said mounting means is a portion of an air channel.

12. The assembly of claim 1 wherein said heating element is held apart from said mounting means and said support structure.

13. The assembly of claim 12 wherein said support means further comprises a plurality of insulators.

14. A reduced vibration electric heater comprising:

a support structure having a plurality of arms, said arms each having a width, a thickness, a top and a bottom;

a heating element supported on said support structure; and, a wall having at least one opening for slidingly receiving one of said plurality of arms;

wherein said at least one opening comprises a flexible first portion contacting said arm top and a second portion spaced apart from said first portion and contacting said arm bottom.

15. The heater of claim 14 wherein said first portion extends away from said wall at an acute angle.

16. The heater of claim 15 wherein said first portion biases one of said plurality of arms against said second portion.

17. The heater of claim 14 wherein said second portion comprises first and second spaced apart contacts.

18. The heater of claim 14 wherein the width of said opening is greater than the width of said arm.

19. The heater of claim 18 wherein said each of said plurality of arms includes a terminal end and a shoulder spaced inwardly of said terminal end, said shoulder having a width greater than the width of said opening.

20. The heater of claim 14 wherein each of said plurality of arms includes first and second side edges lying generally in the same plane, and a central portion between said side edges and being bowed away from said plane.

21. The heater of claim 20 wherein said first contact engages said first side edge, said second contact engages said second side edge and said first portion engages said central portion.

* * * * *